US006581794B2

(12) United States Patent
Boukobza

(10) Patent No.: US 6,581,794 B2
(45) Date of Patent: Jun. 24, 2003

(54) PLASTIC CONTAINER WITH NON-CYLINDRICAL BODY REINFORCED WITH PERIPHERAL GROOVES

(75) Inventor: Michel Boukobza, Le Havre Cedex (FR)

(73) Assignee: Sidel, Le Havre Cedex (FR)

( * ) Notice: Subject to any disclaimer, the term of this patent is extended or adjusted under 35 U.S.C. 154(b) by 0 days.

(21) Appl. No.: 10/182,242

(22) PCT Filed: Jan. 26, 2001

(86) PCT No.: PCT/FR01/00264

§ 371 (c)(1),
(2), (4) Date: Jul. 25, 2002

(87) PCT Pub. No.: WO01/58766

PCT Pub. Date: Aug. 16, 2001

(65) Prior Publication Data

US 2003/0010743 A1 Jan. 16, 2003

(30) Foreign Application Priority Data

Feb. 10, 2000 (FR) ..... 0001771

(51) Int. Cl.[7] ..... B65D 1/02; B65D 1/42

(52) U.S. Cl. ..... 215/383; 215/382; 220/672; 220/675

(58) Field of Search ..... 215/382–384, 215/879; 220/669, 672, 675; D9/541, 502, 569

(56) References Cited

U.S. PATENT DOCUMENTS 3,176,879 A * 4/1965 Mojonnier ..... 220/669
5,746,339 A * 5/1998 Petre et al. ..... 215/383
D398,538 S * 9/1998 Fuquen et al. ..... D9/542
5,988,417 A 11/1999 Cheng et al.
D423,940 S * 5/2000 Chimetto ..... D9/541
D424,948 S * 5/2000 Ullmo ..... D9/540

FOREIGN PATENT DOCUMENTS

FR 1 397 037 A 8/1965
FR 90 987 E 7/1968

OTHER PUBLICATIONS

US Patent Application Publication US2001/0022291 A1, to Shimada et al, Published Sep. 2001.*

Patent Abstracts of Japan, vol. 1998, No. 14, Dec. 31, 1998 & JP 10 236450 A (Toyo Seikan Kaisha Ltd), Sep. 8, 1998 *abstract*.

* cited by examiner

*Primary Examiner*—Sue A. Weaver
(74) *Attorney, Agent, or Firm*—Sughrue Mion, PLLC

(57) ABSTRACT

The invention concerns improvements to containers, in particular plastic bottles, having a body (2) with a circular non-cylindrical wall, so as to reinforce them and prevent cross-section variation when they are subjected to compression forces. Part at least of the wall is provided with a substantially planar relief. The wall is reinforced with peripheral grooves (26, 27, 28, 29, 30) oriented in planes substantially perpendicular to the longitudinal axis (X) of the container, and the part including a substantially planar relief is run through with several grooves. The width of each of the grooves is such that it is less wide (L2) where it emerges in the part of the wall than at the middle (L1) of its crossing. The invention is particularly useful for reinforcing large capacity bottles.

7 Claims, 2 Drawing Sheets cross section DD cross section CC cross section BB cross section AA

PLASTIC CONTAINER WITH NON-CYLINDRICAL BODY REINFORCED WITH PERIPHERAL GROOVES

BACKGROUND OF THE INVENTION

A purpose of the invention is to improve containers made of plastic material, the non-cylindrical body of which is reinforced by reinforcing means composed of peripheral grooves. It can be applied to any type of container the body of which has at least one wall part with an appreciably flat relief, which is the case with bottles. It also applies, and quite particularly, to bottles the body of which has a cross section that is generally quadrilateral in shape, with rounded corners, intended to contain so-called flat liquids, i.e., with no internal pressure.

Throughout the text of the present application, the terms relating to a spatial position of a container or of various parts of a container relative to each other should be understood as being when the container is standing, that is, oriented vertically along its longitudinal axis, with the bottom down and the neck up. This is true particularly, but not exclusively, for the terms above, below, lower, upper, up, down, height, vertical, horizontal, etc.

It is known that containers made of plastic material are becoming lighter and lighter, which creates problems in obtaining good mechanical strength both in the longitudinal as well as in the transversal direction.

Consequently, when they are picked up, especially after being opened, they have a tendency to crush, which could cause the contents to be discharged, particularly when said contents are liquid.

When the containers are closed, compression forces occur when they are stacked on top of each other during storage or transport. If their walls are not sufficiently rigid, the result is an increase in the cross section of the body of each of the containers supporting others. This is due to the fact that the pressure exerted above a container causes its shoulders to sag, thus increasing the internal pressure of the container, which then affects the internal walls. If the containers are strapped to each other, the risk is then that, when the cross section is increased, the stresses exerted between two adjacent containers become excessive, which can lead to mutual damage by compression, for example.

These disadvantages are partially remedied by producing containers having a succession of reinforcing grooves at the periphery of their body. However, although this solution has proven generally satisfactory for containers having a body with cylindrical cross section, both when they are handled after being opened as well as when they are stacked, this is not the case for containers having at least one wall part with appreciably flat relief, such as containers having a body with cross section that is generally quadrilateral in shape, with rounded corners, particularly when they are stacked. This frequently results in a significant increase in their cross section, by outward deformation of the parts of flat walls between two successive grooves.

SUMMARY OF THE INVENTION

These phenomena become more acute as the internal volume of the containers increases (more liters) and/or when the hydrostatic pressure exerted by their contents is large. Indeed, when forces due to hydrostatic or other pressure tending to increase the cross section of the walls of a container are present, they tend to be exerted more at the center of the flat or appreciably flat areas than on their edges.

This explains the outward deformations of the parts of walls between two successive grooves that can be observed in these known containers.

A purpose of the invention is to remedy these disadvantages.

According to the invention, a container made of plastic material, having a body oriented along a longitudinal axis, with a non-cylindrical wall around this axis, the wall being reinforced by peripheral grooves oriented along planes that are appreciably perpendicular to said longitudinal axis, at least one part of said wall having an appreciably flat relief and being traversed by several grooves, is characterized in that the width of each groove traversing the part of wall having an appreciably flat relief is variable, the variation in width of each of said grooves being such that it is less wide at its end in said wall part than in the middle of its crossover.

It will be noted that this special structure makes it possible to avoid significant outward deformations of the wall parts that are appreciably flat, between two successive grooves.

According to another feature, a projection of the bottom of a groove, on its orientation plane that is appreciably perpendicular to said longitudinal axis, traversing a part of wall having an appreciably flat relief, has, at least along the crossover, a curved profile with a concavity turned toward the outside of the wall.

This particular shape gives greater rigidity to the bottoms of the grooves, which makes it possible to limit the deformations they undergo during recovery from stresses.

According to another feature, the walls of the grooves have a curved profile.

In this way the creation is avoided of angular areas that could break under the effect of stresses due to pressure, shock or other phenomena.

BRIEF DESCRIPTION OF THE DRAWINGS

Other characteristics and advantages of the invention will appear from the following description of the figures, which illustrate respectively.

DETAILED DESCRIPTION OF THE INVENTION

Figure 3:
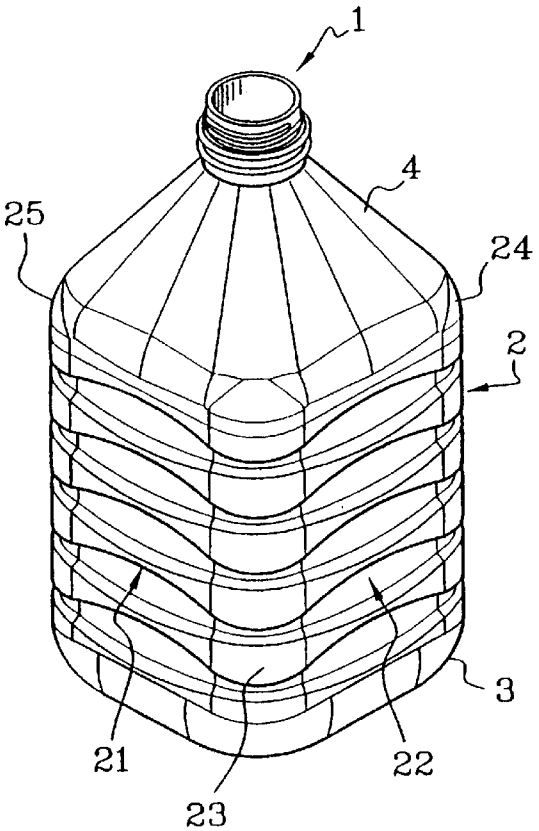
FIG. 3, a view in perspective, slightly tilted, of the bottle represented in FIGS. 1 and 2.

The bottle, with longitudinal axis X, represented in FIGS. 1 to 5, has a neck 1, a body 2, a bottom 3, and an intermediate part called shoulder 4, between the body and the neck.

In a known way, in the example illustrated, the neck ends in a threaded part 5, allowing a threaded cap to be screwed on.

In the illustrated example, the body 2 of the bottle has a cross section that is generally quadrilateral in shape, square in this example, with rounded corners, so that the wall of the body is composed of parts in the form of appreciably flat panels, two of which 21, 22 are visible in FIG. 3, connected to each other by parts of rounded corners, three of which 23, 24, 25 are visible in said FIG. 3.

Figure 2:
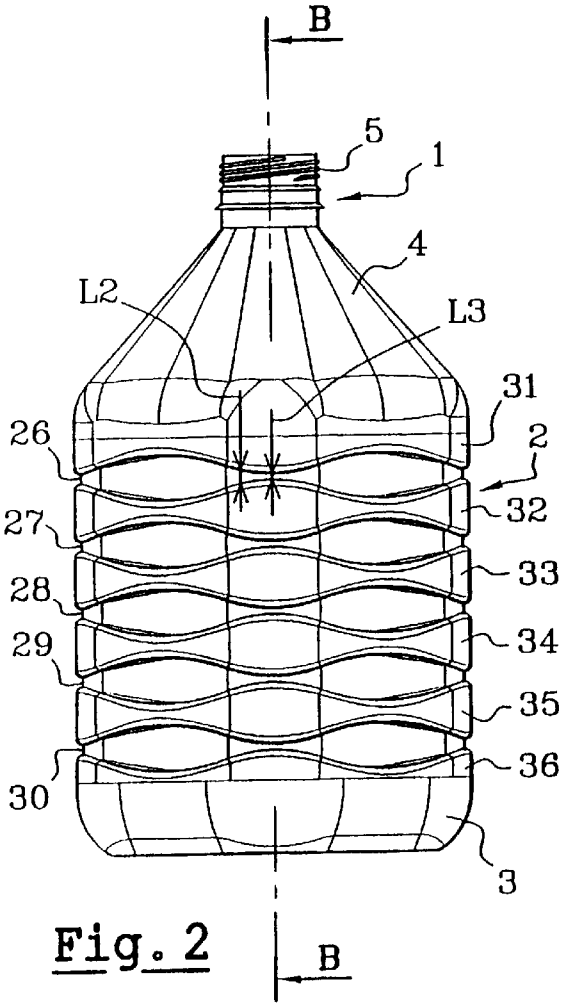
FIG. 2, an angular view of the bottle of FIG. 1.
Figure 1:
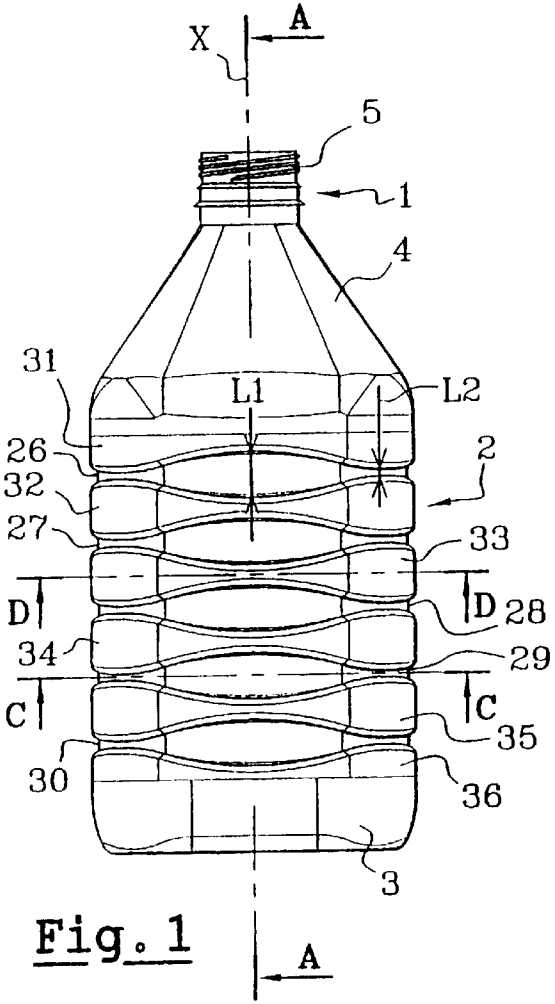
FIG. 1, a view in elevation of one form of embodiment of a bottle with quadrilateral cross section, comprising a type of container to which the present invention is applicable.

As can be seen more particularly in FIGS. 1 to 3, the wall is reinforced by peripheral grooves 26, 27, 28, 29, 30, all of which are appreciably oriented along planes perpendicular to the longitudinal axis. Each groove encircles the body by traversing the different appreciably flat panels 21, 22 and rounded corner parts 23, 24, 25. The result is that the wall, in a vertical direction, is composed of an alternation of sections 31, 32, 33, 34, 35, 36 of wall having the above-mentioned cross section that is generally quadrilateral in shape, with rounded corners, and peripheral grooves.

According to the invention, the peripheral grooves have a variation in width at least where they cross a part of wall having an appreciably flat relief. In the case of the bottle illustrated in the figures, it is therefore at least where they cross each of the panels 21, 22 that the width varies, and the variation in width of each of the grooves is such that it is less wide at its ends in a panel than at the middle of its crossover.

Thus, with the bottle illustrated by FIGS. 1 to 7, which has four flat panels, each groove has at least four variations in width.

Moreover, in referring to FIG. 1, which is a view in elevation of the bottle, it can be seen on an appreciably flat panel that, for example, the groove 26 has a width L1 in the middle of where it crosses the panel, which is greater than its width L2 at each of its ends in said panel.

Each of the other grooves has the same characteristics, so that the flat portions of sections 31, 32, 33, 34, 35, 36 delimited by the grooves have less width where the grooves have greater width, and vice versa.

In other words, two successive grooves across said part of appreciably flat wall, a panel in the case of the bottle illustrated in the figures, are separated by a section of panel the width of which changes in inverse proportion to that of the grooves, that is, this section is less wide at its middle than at its sides, at the end of the grooves. In other words, two adjacent grooves are closer to each other at the middle of their crossover of a panel than at their end.

This particular structure makes it possible to prevent significant outward deformations of appreciably flat wall parts between two successive grooves, particularly in the following way:

because of the reduction in width of the flat areas in the middle of the crossover, here sections of panels 31, 32, 33, 34, 35, 36, these flat areas offer a limited surface area to stresses, while the surface area offered by the bottom of the grooves 26, 27, 28, 29, 30 at that place is greater, so that the deformation forces are absorbed by the bottom of the grooves. This bottom can be deformed, but the deformation does not exceed the plane passing through the flat areas on either side of the groove;

at the edges, and therefore at the ends of the grooves, where the surface area offered by a portion of the flat area between two successive grooves is greater, the absence of deformation is explained in part, first because the stresses that exist at that location are less, and second by a scaffolding effect achieved by the edges of the grooves on either side of said flat area portion.

In the example illustrated by the figures, the successive grooves all have the same variations in width, on the one hand, and similar or identical dimensions on the other. However, it will be noted that this similarity is not necessary, the essential part being that in the middle of their crossover of a flat part, the width of each groove is greater, and the width of each flat portion of a section is smallest.

In the form of embodiment illustrated by the figures, particularly in reference to FIGS. 2 and 3, it will be noted that the width of the groove continues to decrease until it reaches a value of L3 less than L2 in the middle of its crossover of the rounded corner 23. However, it will also be noted that this arrangement is not essential, and that the width of the groove could remain constant and preserve the value L2 where it crosses.

The profile of the walls of each groove is composed of an alternation of curves or windings. This prevents the creation of sharp angles that are often areas where breaking begins.

Figure 4:
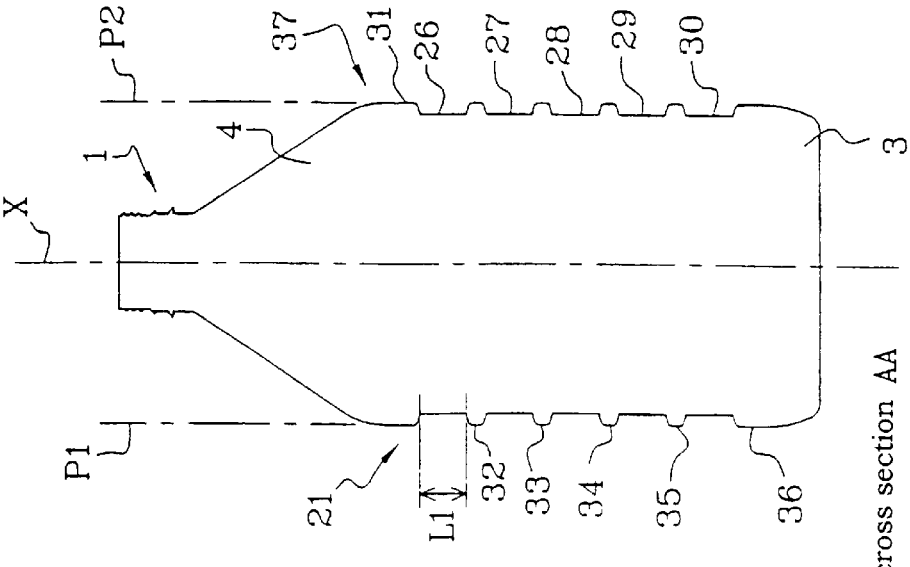
FIG. 4, a cross-sectional view along line AA of the bottle represented in FIG. 1.

FIG. 4, which is a cross-sectional view along AA of FIG. 1, shows that the bottom of the grooves, in the middle of panels 21, 37, is far enough away from planes P1, P2—indicated by broken lines—of the panels, so that if the forces tend to push the bottom of the grooves outward, when they are absorbing the forces, it is quite unlikely that the deformation would become such that the bottoms reach the limits of the planes P1, P2.

Figure 5:
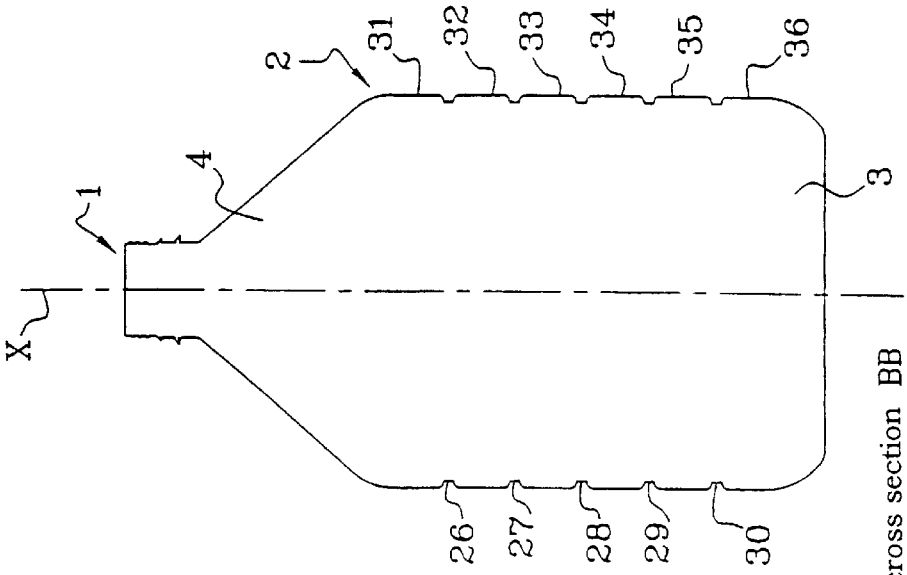
FIG. 5, a cross-sectional view along line BB of the bottle represented in FIG. 2.

FIG. 5, which is a cross-sectional view along BB of FIG. 2, shows that to the right of the rounded corners, the width of the grooves is less. However, at this location the stresses are usually less than in the middle, so that the risks of cross-section increase here are nearly non-existent.

Figure 6:
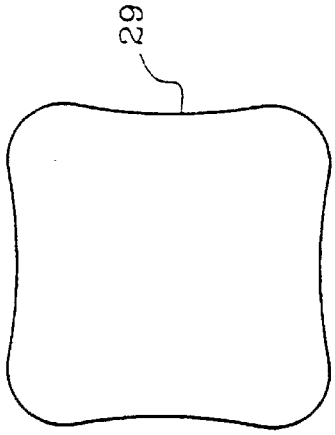

FIG. 6, which is a cross-sectional view along CC of FIG. 1, that is, a central cross section of the bottom of a groove 29, illustrates one preferred form of embodiment of the profile of the bottom of the grooves that makes it possible to give them greater rigidity and to limit the deformations they undergo when absorbing forces. According to this form of embodiment, the projection of the bottom of the grooves, on their plane of orientation appreciably perpendicular to the longitudinal axis X, has, at least along the crossover of the parts in the form of appreciably flat panels, a curved profile, with a concavity turned toward the outside of the wall.

Figure 7:
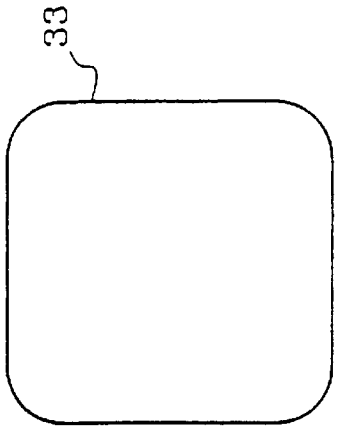
FIGS. 6 and 7, cross-sectional views along lines CC and DD, respectively, of the bottle represented in FIG. 1.

Finally, FIG. 7 shows, in cross section DD of FIG. 1, a center cross section of a portion 33 of wall having the above-mentioned general quadrilateral shape, with rounded corners and flat parts.

The bottle according to the invention can be obtained by the methods called injection blow molding, that is, methods in which a preform of plastic material, previously obtained by injection, is temperature conditioned, then blow-molded, or alternatively stretched then blow-molded, in a finish mold.

It can then be obtained by extrusion blow-molding of a tubular parison.

Obviously, the invention is not limited to the forms of embodiment described and specifically claimed; it encompasses all equivalents available to a person skilled in the art.

What is claimed is:

1. A container, which is made of plastic material, having a body (2) oriented along a longitudinal axis (X), with a non-cylindrical wall around this axis, the wall being reinforced by peripheral grooves (26, 27, 28, 29, 30) oriented along planes that are appreciably perpendicular to said longitudinal axis, at least one part (21, 22) of said wall having an appreciably flat relief and being traversed by several grooves, wherein a width of each groove traversing the part of wall having an appreciably flat relief is variable, the variation in the width (of each of said grooves being such that the width is less wide (L2) at an end in said wall part than in a middle (L1) of a crossover.

2. The container according to claim 1, wherein a bottom of a groove (29) traversing the part of wall having an appreciably flat relief (21, 22) has, at least along the crossover of that part, a curved profile with a concavity turned toward the outside of the wall.

3. The container according to claim 1, wherein the profile of the walls of each groove is composed of an alternation of curves or windings.

4. The container according to claim 1, wherein the body (2) has a cross section that is generally quadrilateral in shape, with rounded corners, so that the wall of the body is composed of the appreciably flat relief parts in the form of appreciably flat panels (21, 22), connected to each other by the rounded corners, and the peripheral grooves (26, 27, 28, 29, 30) have a variation in width in their crossover of a panel (21, 22), and the variation in width of each of the grooves is such that it is less wide at its ends in a panel than at the middle of its crossover.

5. The container according to claim 4, wherein a width (L3) of a groove in the middle of its crossover of a rounded corner part (23) is less than that (L2) at its ends in the panels.

6. The container according to claim 4, wherein a width (L3) of a groove in the middle of its crossover of a rounded corner part (23) is equal to that (L2) at its ends in the panels.

7. The container according to claim 1, wherein the container comprises a bottle.

* * * * *